US011819987B2

(12) United States Patent
Fu

(10) Patent No.: US 11,819,987 B2
(45) Date of Patent: Nov. 21, 2023

(54) DUAL-MODE ADJUSTABLE PLIERS

(71) Applicant: Apex Brands, Inc., Apex, NC (US)

(72) Inventor: Zhihong Fu, Cary, NC (US)

(73) Assignee: APEX BRANDS, INC., Ape, NC (US)

( * ) Notice: Subject to any disclaimer, the term of this patent is extended or adjusted under 35 U.S.C. 154(b) by 0 days.

(21) Appl. No.: 17/914,417

(22) PCT Filed: Mar. 30, 2021

(86) PCT No.: PCT/US2021/024770
§ 371 (c)(1),
(2) Date: Sep. 26, 2022

(87) PCT Pub. No.: WO2021/206951
PCT Pub. Date: Oct. 14, 2021

(65) Prior Publication Data

US 2023/0108793 A1 Apr. 6, 2023

Related U.S. Application Data

(60) Provisional application No. 63/005,968, filed on Apr. 6, 2020.

(51) Int. Cl.
*B25B 7/10* (2006.01)

(52) U.S. Cl.
CPC ..... *B25B 7/10* (2013.01)

(58) Field of Classification Search
CPC .... B25B 7/00; B25B 7/04; B25B 7/10; B25B 7/14; B25B 7/16; B25B 13/10;
(Continued)

(56) References Cited

U.S. PATENT DOCUMENTS 4,269,089 A * 5/1981 Hastings ..... B25B 13/36 81/411
5,060,543 A 10/1991 Warheit
(Continued)

OTHER PUBLICATIONS

First Examination Report issued in corresponding Australian Application No. 2021252471 dated Nov. 4, 2022, all enclosed pages cited herein.

(Continued)

*Primary Examiner* — Robert J Scruggs
(74) *Attorney, Agent, or Firm* — BURR & FORMAN LLP

(57) ABSTRACT

Dual-mode adjustable pliers include a first handle member including a first handle and a first jaw and a second handle member including a second handle and a second jaw. The pliers may also include a channel disposed in the first handle member and an adjustable pivot affixed to the second handle member and disposed within the channel. The pliers may also include a movable mode selector member. In an engaged position, the mode selector member is engaged with both the first handle member and the second handle member, and, as the second handle is moved towards the first handle, the adjustable pivot moves within the channel. In a disengaged position, the mode selector member is not engaged with both the first handle member and the second handle member, and, as the second handle is moved towards the first handle, the adjustable pivot maintains a position within the channel.

20 Claims, 9 Drawing Sheets

(58) Field of Classification Search
CPC ..... B25B 13/12; B25B 13/20; B25B 13/22; B25B 13/28; B25B 13/34; B25B 13/48; B25B 7/12; B25B 27/205; B25G 1/00
See application file for complete search history.

(56) References Cited

U.S. PATENT DOCUMENTS

| | | | | |
|---|---|---|---|---|
| 6,014,917 | A * | 1/2000 | Bally | B25B 7/12 81/355 |
| 7,730,810 | B1 | 6/2010 | Janson | |
| 2010/0064861 | A1 | 3/2010 | Herrmann | |
| 2017/0066111 | A1 * | 3/2017 | Wang | B25B 13/12 |

OTHER PUBLICATIONS

International Search Report and Written Opinion of corresponding International Application No. PCT/US2021/024770, dated Jun. 24, 2021, all enclosed pages cited herein.

* cited by examiner

DUAL-MODE ADJUSTABLE PLIERS

TECHNICAL FIELD

Example embodiments generally relate to hand tool technology, and in particular to adjustable plier technology.

BACKGROUND

Pliers have proved to be effective tools for grasping fasteners, fittings, or the like in a variety of circumstances. However, because variations in the size of fasteners and fittings are numerous, a need for adjustability with respect to pliers arose. This need was met by the introduction of adjustable pliers that permit the handle members of the pliers to slide relative to each other to increase the spacing between the jaws of the pliers to allow for grasping a wide range of fastener or fitting sizes. While adjustable pliers met a need for not requiring many different sizes of pliers to accomplish a variety of tasks, the adaptability of conventional adjustable pliers is still limited in many ways. As such, continued innovation in the area of adjustable pliers is needed to further the adaptability and effectiveness of pliers in a variety of applications.

BRIEF SUMMARY OF SOME EXAMPLES

According to some example embodiments, dual-mode pliers are provided. In this regard, the dual-mode pliers may comprise a first handle member comprising a first handle and a first jaw, a second handle member comprising a second handle and a second jaw, and a channel disposed in the first handle member between the first handle and the first jaw. The dual-mode pliers may also comprise an adjustable pivot affixed to the second handle member and disposed within the channel of the first handle member. The second handle member may be configured to pivot relative to the first handle member about a pivot axis defined by the adjustable pivot. The dual-mode pliers may also comprise a mode selector member that is movable between an engaged position and a disengaged position. In the engaged position, the mode selector member is engaged with both the first handle member and the second handle member, and, as the second handle is moved towards the first handle, the adjustable pivot moves the pivot axis within the channel to slide the second jaw towards first jaw. In the disengaged position, the mode selector member is not engaged with both the first handle member and the second handle member, and, as the second handle is moved towards the first handle, the adjustable pivot maintains a position of the pivot axis within the channel.

According to some example embodiments, adjustable pliers configured to transition between a single handed auto-adjustment mode and a hand adjustment mode are provided. The adjustable pliers may comprise a first handle member comprising a first handle and a first jaw, a second handle member comprising a second handle and a second jaw, a channel disposed in the first handle member between the first handle and the first jaw, and an adjustable pivot affixed to the second handle member and disposed within the channel. The second handle member may be configured to pivot relative to the first handle member about a pivot axis defined by the adjustable pivot. The adjustable pliers may also comprise a mode selector member that is affixed to the second handle member between the adjustable pivot and the second handle. The mode selector member may be rotatable between an engaged position, where the mode selector member is in contact with the first handle member, and a disengaged position, where the mode selector member is not in contact with the first handle member. In the engaged position, as the first handle is moved towards the second handle, the adjustable pivot moves the pivot axis within the channel to slide the second jaw towards first jaw. In the disengaged position, as the first handle is moved towards the second handle, the adjustable pivot maintains a position of the pivot axis within the channel.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
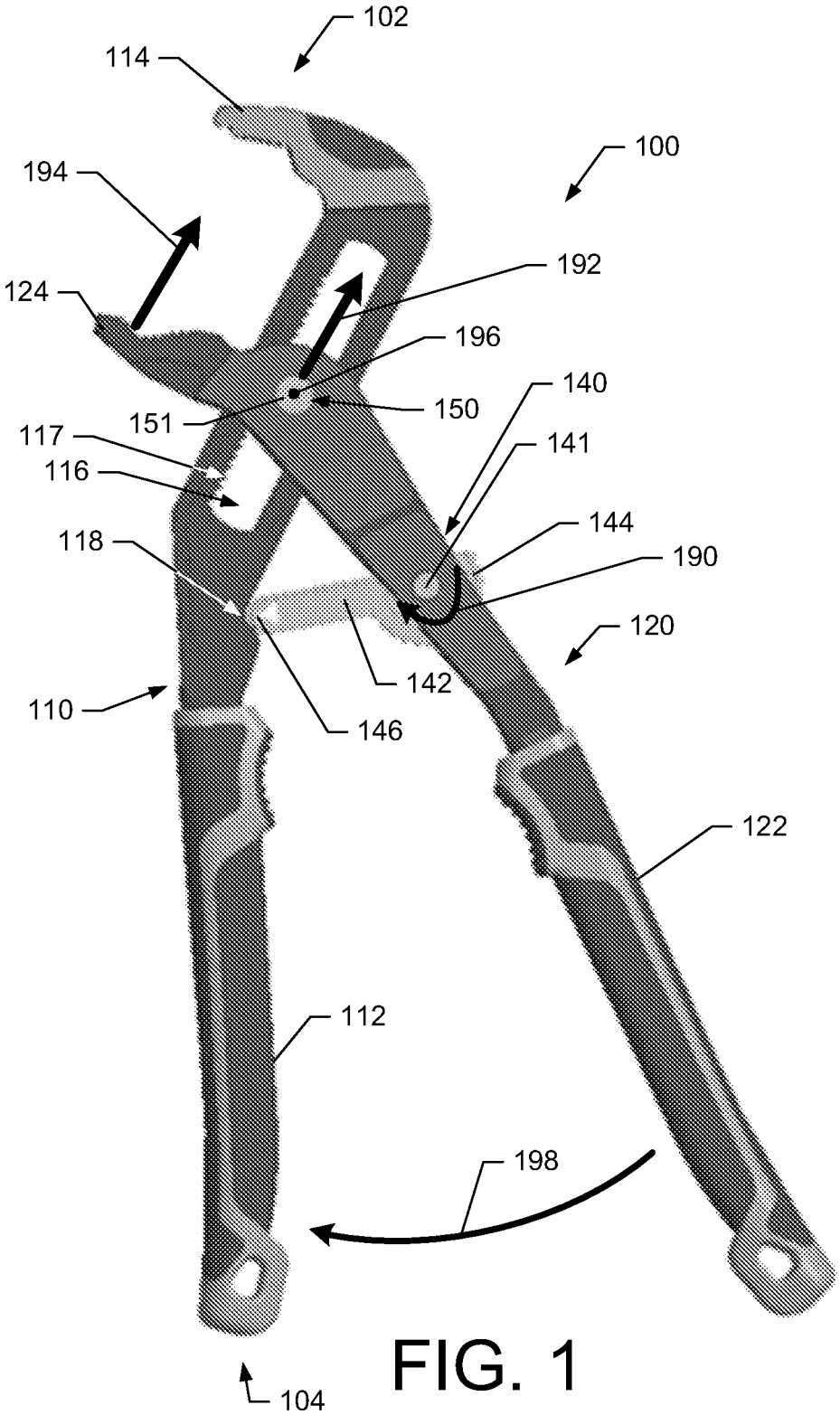
FIG. 1 illustrates a side view of example pliers in an open position with a mode selector member in an engaged position according to some example embodiments.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other. As used herein, operable coupling should be understood to relate to direct or indirect connection that, in either case, enables functional interconnection of components that are operably coupled to each other.

Various example embodiments described herein are directed to dual-mode, adjustable pliers. Such pliers may be configurable to operate in a first mode as adjustable pliers that, once a pivot position is set for desired jaw distancing, the pliers continue to operate in that position until the user resets the pivot position to a different position. In a second mode, the example pliers may operate as auto-adjusting pliers whereby, as the user moves the handles of the pliers towards each other, the jaws of the pliers automatically slide toward each other until, for example, the jaws close upon a fastener. The ability to transition between these modes while using the example pliers adds significant flexibility and efficiency to a variety of applications.

For example, in a situation where a user needs to act upon a number of fasteners of the same size-which is frequently the case-a user can first place the example pliers in the auto-adjustment mode. In this mode, the user may apply the example pliers to the first fastener. Because the example pliers are in the auto-adjustment mode, the jaws of the example pliers may slide together and auto-adjust down to onto the fastener, to the optimal spacing for the jaws for the size of the fastener. The user may then transition to the example pliers out of the auto-adjustment mode and into a hand adjusting mode, which will maintain the spacing of the jaws of the example pliers. The user may then operate on the first fastener, for example, to turn the fastener in a desired direction (e.g., tighten or loosen). After operating on the first fastener, the user may remove the example pliers from the first fastener to move the example pliers to a second fastener. Because the example pliers are in the hand adjusting mode (and not in the auto-adjustment mode), the relative spacing of the jaws will be maintained, even if the handles are moved into a closed position (handles are moved towards each other) while the jaws are not engaged with a fastener. As such, the user may move the example pliers directly to the second fastener, without concern that the jaws have changed spacing, because the pliers are no longer in the auto-adjustment mode. Henceforth, additional fasteners of the same size can continue to be engaged with the spacing between the jaws being maintained.

As such, according to some example embodiments, the example pliers may provide for selectively engaging or disengaging the auto-adjustment mode. Further, the example pliers may be controlled by the user to transition between an auto-adjustment mode and a hand adjusting mode via the actuation of a mode selector member. In the auto-adjustment mode, the mode selector member may be positioned such that the mode selector member is in an engaged position, where the mode selector member is in contact with both handle members of the example pliers. In the engaged position, two points of engagement between the handle members may be provided, i.e., a pivot axis defined by an adjustable pivot of the pliers and the engagement via the mode selector member. As such, with the mode selector member in the engaged position, the example pliers may auto-adjust the position of the adjustable pivot and the distance between the jaws, as further described below.

The mode selector member may also be positioned in a disengaged position, where the mode selector member is not engaged or in contact with both the handle members of the example pliers. In the disengaged position, the example pliers may operate in a hand adjusting mode. In the hand adjusting mode, the adjustable pivot and the associated pivot axis may maintain a current position, thereby maintaining a current distance between the jaws, as the handles of the example pliers are moved towards each other. To change a position of the adjustable pivot, the handles may be moved away from each other into an adjustment separation position where the adjustable pivot is permitted to slide, via urging by user's hand, to increase or decrease the distance between the jaws. According to some example embodiments, moving the adjustable pivot and the pivot axis in a direction that increases the distance between the jaws may only be performed in the hand adjusting mode.

Having described some aspects of example embodiments in general terms, reference is now made to FIG. 1, which illustrates an example embodiment of dual-mode, adjustable pliers 100, according to some example embodiments. The pliers 100 may define a forward end 102 and a rearward end 104. With respect to the structure, the pliers 100 may comprise a first handle member 110, a second handle member 120, and an adjustable pivot 150.

The first handle member 110 may be an elongate member that comprises a first handle 112 and a first jaw 114. The first handle 112 may be disposed at a rearward end of the first handle member 110 and may include a portion that extends rearward that may form the first handle 112, or the first handle 112 may be attached to the rearward extending portion. For example, the first handle 112 may comprise a grip (e.g., a rubberized grip) that may be affixed to the rearward extending portion of the first handle member 110. The first jaw 114 may be disposed at the forward end of the first handle member 110. The first jaw 114 may be configured to engage a fastener, fitting, or the like on at least one side. In this regard, the first jaw 114 may include example features such as gripping teeth and notches that are configured to grip or facilitate no-slip or reduced slip engagement with fasteners, fittings, or the like.

The second handle member 120 may be an elongate member that comprises a second handle 122 and a second jaw 124. The second handle 122 may be disposed at a rearward end of the second handle member 120 and may include a portion that extends rearward that may form the second handle 122, or the second handle 122 may be attached to the extended portion. For example, the second handle 122 may comprise by a grip (e.g., a rubberized grip) that may be affixed to the rearward extending portion of the second handle member 120. The second jaw 124 may be disposed at the forward end of the second handle member 120. The second jaw 124 may be configured to engage a fastener, fitting, or the like on at least one side. In this regard, the second jaw 124 may include example features such as gripping teeth and notches that are configured to grip or facilitate no-slip or reduced slip engagement with fasteners, fittings, or the like.

The first handle member 110 may also comprise a channel 116. The channel 116 may be formed as an opening in the first handle member 110 and may extend along a length of the first handle member 110 between the first handle 112 and the first jaw 114. According to some example embodiments, the channel 116 may include channel teeth 117, disposed on a side edge of the channel 116, that may be configured to permit ratcheting movement of the adjustable pivot 150, as further described below.

The adjustable pivot 150 may be affixed to the second handle member 120 at a position between the second jaw 124 and the second handle 122 by a pin 151. As further described with respect to FIGS. 4-6 below, the adjustable pivot 150 may define a pivot position 196, about which the first handle member 110 may pivot relative to the second handle member 120. Further, the adjustable pivot 150 may be disposed within the channel 116 and the first handle member 110 may be coupled to the second handle 122 by the adjustable pivot 150 being disposed within the channel 116. The adjustable pivot 150 may be configured to move, in a sliding fashion, within the channel 116. Movement of the adjustable pivot 150, and the associated pivot position 196, within the channel 116 may allow for the adjustability of the pliers 100. As the adjustable pivot 150 moves forward within the channel 116, the first jaw 114 moves toward the second jaw 124, decreasing the jaw spacing of the pliers 100. Also, as the adjustable pivot 150 moves rearward in the channel 116, the first jaw 114 moves away from the second jaw 124, increasing the jaw spacing of the pliers 100.

The pliers 100 may also comprise a mode selector member 140. According to some example embodiments, the mode selector member 140 may be affixed to the second handle member 120, for example, at a position between the adjustable pivot 150 and the second handle 122. The mode selector member 140 may be affixed to the second handle member 120, for example, via a pin 141 that passes through the mode selector member 140 and the second handle member 120. In this regard, the pin 141 may permit the mode selector member 140 to rotate about the pin 141 and relative to the second handle member 120. The mode selector member 140 may include a body portion 144 that, for example, includes an opening to receive the pin 141. According to some example embodiments, the body portion 144 may also include a user grip feature that facilitates a user's ability to rotate the mode selector member 140. In the example embodiments shown in FIG. 1, the user grip feature is a series of notches on a curved edge of the body portion 144 that extends beyond an edge of the second handle member 120 to permit a user to use a finger (e.g., thumb) to rotate the mode selector member 140. According to some example embodiments, the mode selector member 140 may further comprise an arm 142.

The mode selector member 140 may, according to some example embodiments, be rotated between a first position, also referred to as the engaged position, and a second position, referred to as the disengaged position. In the engaged position, the arm 142 is rotated towards the first handle member 110, such that the first handle member 110 may come into contact with a tip 146 of the arm 142, if the second handle 122 is moved towards the first handle 112 (i.e., in the direction of the arrow 198). In the engaged position, the tip 146, which may be rounded (e.g., convex), may engage with a corresponding engagement notch 118 in the first handle member 110. According to some example embodiments, the engagement notch 118 may be rounded (e.g., concave) to receive the tip 126 of the arm 142. Alternatively, in the disengaged position, the arm 142 may be rotated away from the first handle member 110, such that the arm 142 of mode selector member 140 does not engage with the first handle member 110 when the second handle 122 is moved towards the first handle 112, as further described below with respect to FIGS. 7 and 8.

Figure 2:
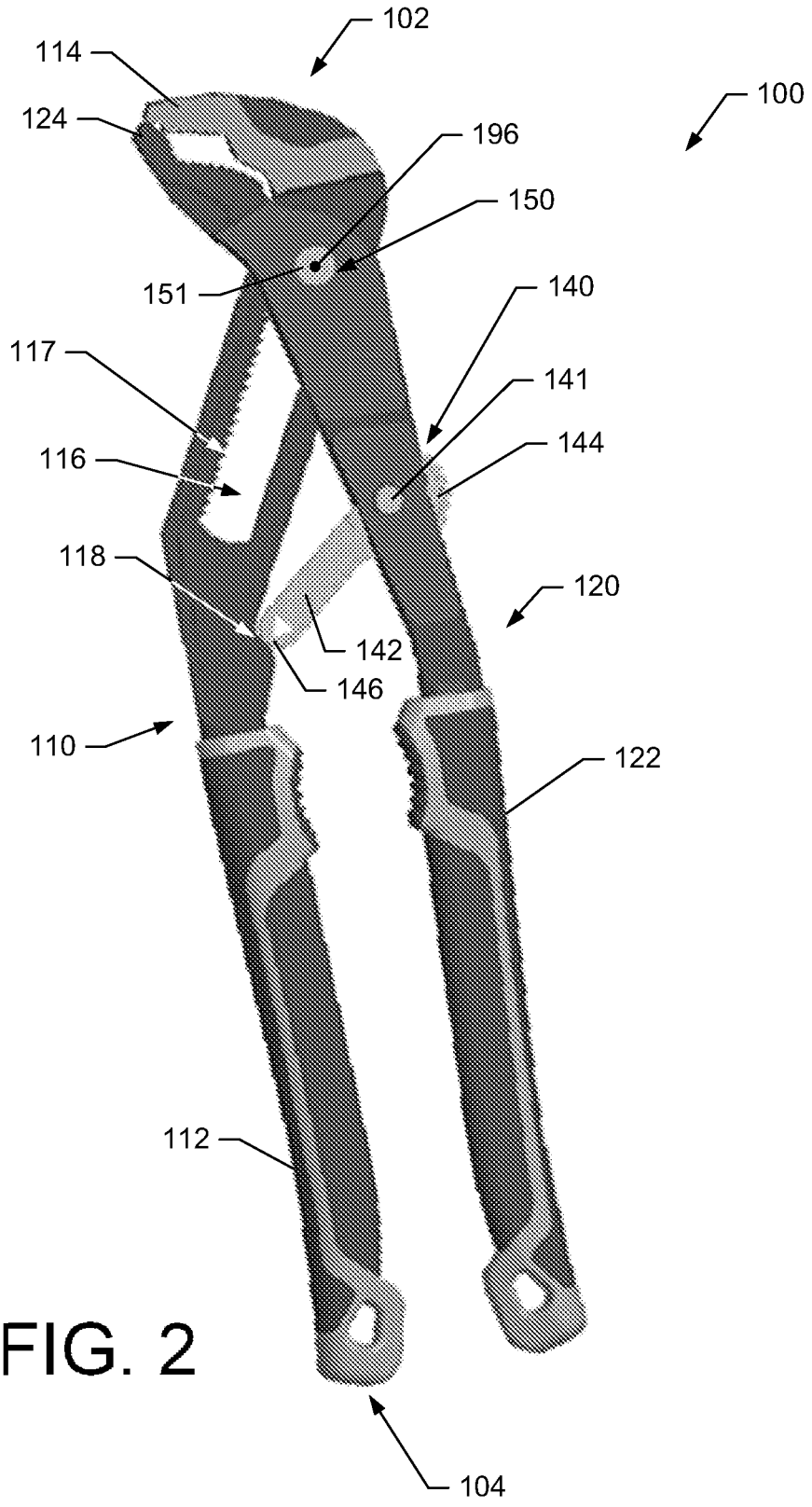
FIG. 2 illustrates a side view of example pliers in a closed position with a mode selector member in an engaged position according to some example embodiments.

With respect to operation of the pliers 100, FIG. 1 shows the mode selector member 140 in the engaged position and the jaws 124 and 114 substantially spaced apart. Because the mode selector member 140 is in the engaged position, an auto-adjustment mode operation may be performed. As the user places a force on the handles 112 and 122 to move the second handle 122 towards the first handle 112 in the direction 198, the adjustable pivot 150 may be urged to slide forward in the channel 116 due to a multi-fulcrum pivoting action. In this regard, as the second handle 122 moves toward the first handle 112, the tip 146 of the arm 142 of the mode selector member 140 may rotate within the notch 118, the second handle member 120 may rotate in the direction 190 about the pin 141, and the second handle member 120 may rotate relative to the first handle member 110 about the pivot position 196. As a result, the adjustable pivot 150 may move within the channel 116 in the direction 192 (e.g., via a ratcheting action as described below) and the second jaw 124 may move in the direction 194 towards the first jaw 114. As such, the second jaw 124 auto-adjusts towards the first jaw 114 until the jaws 114 and 124 meet, or the jaws 114 and 124 clamp onto a fastener, fitting, or the like that be positioned between the jaws 114 and 124. As shown in FIG. 2, the second handle 122 has been moved towards the first handle 112 until the second jaw 124 auto-adjusts to meet the first jaw 114. As also shown in FIG. 2, relative to the positioning of the components of the pliers 100 as shown in FIG. 1, an auto-adjustment of the second jaw 124 has occurred and the tip 146 of the arm 142 has pivoted in the notch 118, the second handle member 120 has rotated about the pin 141, and the second handle member 120 has rotated relative to the first handle member 110 about the pivot position 196.

Figure 3:
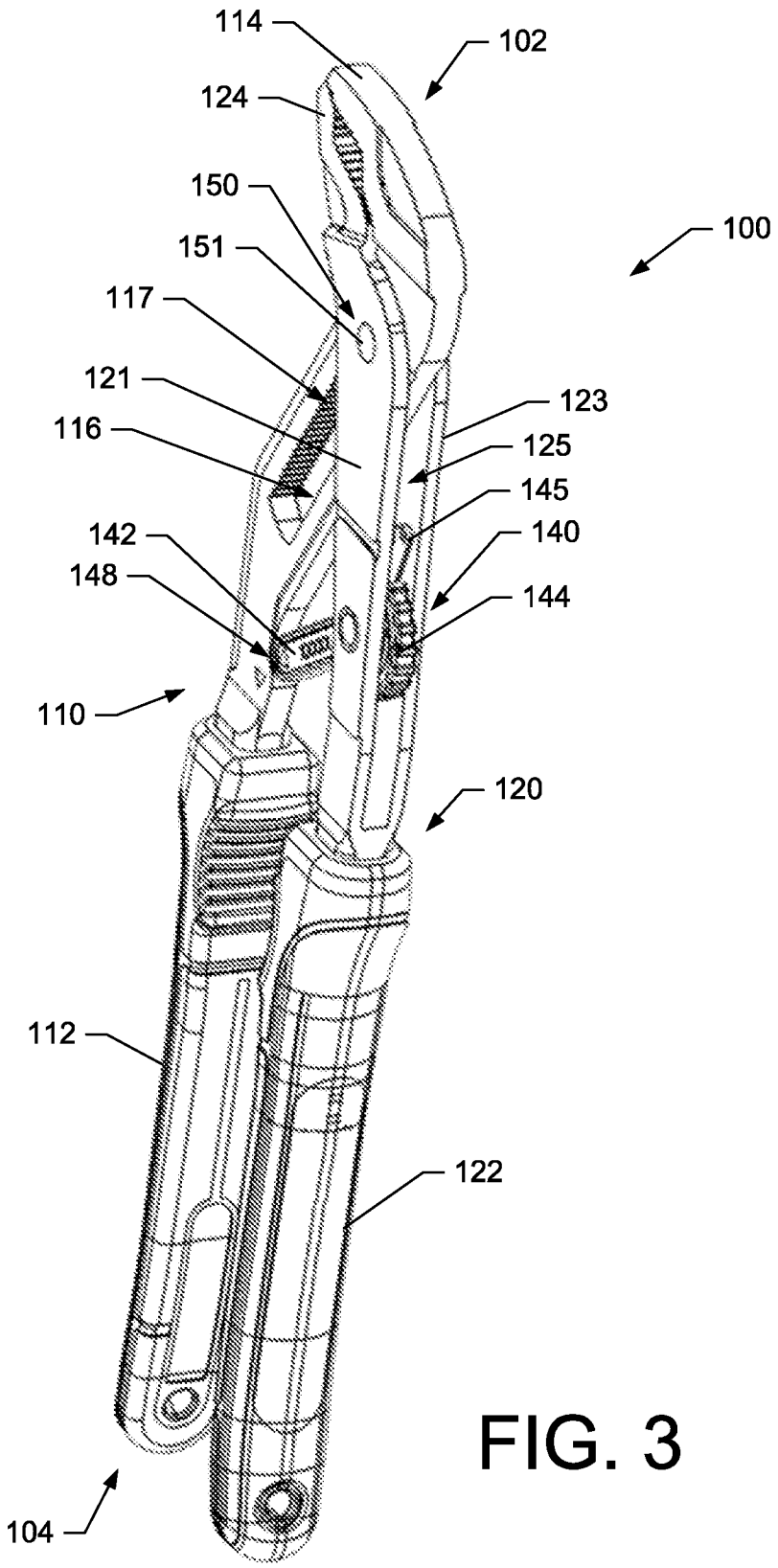
FIG. 3 illustrates a perspective top view of the example pliers in a closed position with a mode selector member in an engaged position according to some example embodiments.

With reference to FIG. 3, the pliers 100 are shown in a top perspective view. As can be seen in FIG. 3, according to some example embodiments, the second handle member 120 may comprise an opening 125 formed by side members 121 and 123. Side members 121 and 123 may be affixed between the second handle 122 and the second jaw 124. According to some example embodiments, the mode selector member 140 may be affixed to the second handle member 120 within the opening 125. Further, the arm 142 of mode selector member 140 may be configured to rotate into the opening 125, when the mode selector member 140 is in the disengaged position, such that the arm 142 is disposed between the side members 121 and 123. Additionally, as shown in FIG. 3, the first jaw 114 portion of the first handle member 110 may, according to some example embodiments, also pass through the opening 125 and be affixed to the second handle member 120 by the adjustable pivot 150 and the pin 151 of the adjustable pivot 150.

Figure 4:
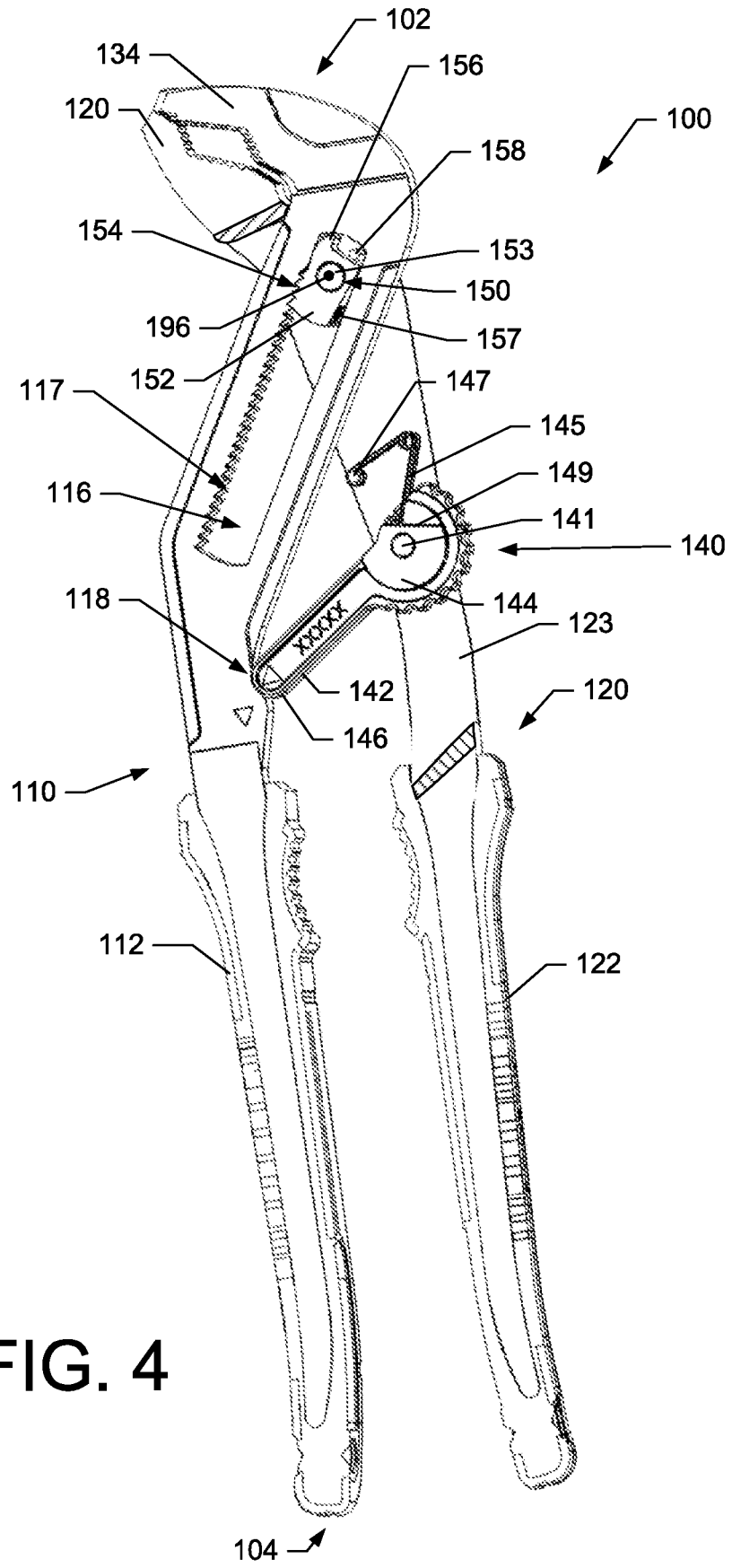
FIG. 4 illustrates a cross-section side view of example pliers in a closed position with a mode selector member in an engaged position according to some example embodiments.

Considering the perspective provided by FIG. 3, FIG. 4 shows a cross-section side view of the pliers 100 such that the side member 121 is removed and the components disposed in the opening 125 are visible. In the regard, a full side view of the mode selector member 140 is shown in FIG. 4. Accordingly, the pliers 100 may also comprise a spring 145 that is coupled to the second handle member 120 and the mode selector member 140. The spring 145, which may be a torsion spring, may be coupled to the second handle member 120 via a protrusion 147 at a first end of the spring 145. A second end of the spring 145 may be engaged with a notched surface 149 on the body portion 144 of the mode selector member 140 and be permitted to slide along the notched surface 149 as the mode selector member 140 is rotated. In operation, the spring 145, via the coupling with the second handle member 120 and the mode selector member 140, may operate to maintain the mode selector member 140 in either the engaged position or the disengaged position by requiring a user to overcome a maximum spring force when moving between the positions. As such, due the bias applied by the spring 145, the mode selector member 140 would tend to remain in either the engaged position or the disengaged position without being intentionally urged by the user into the other position.

Figure 5:
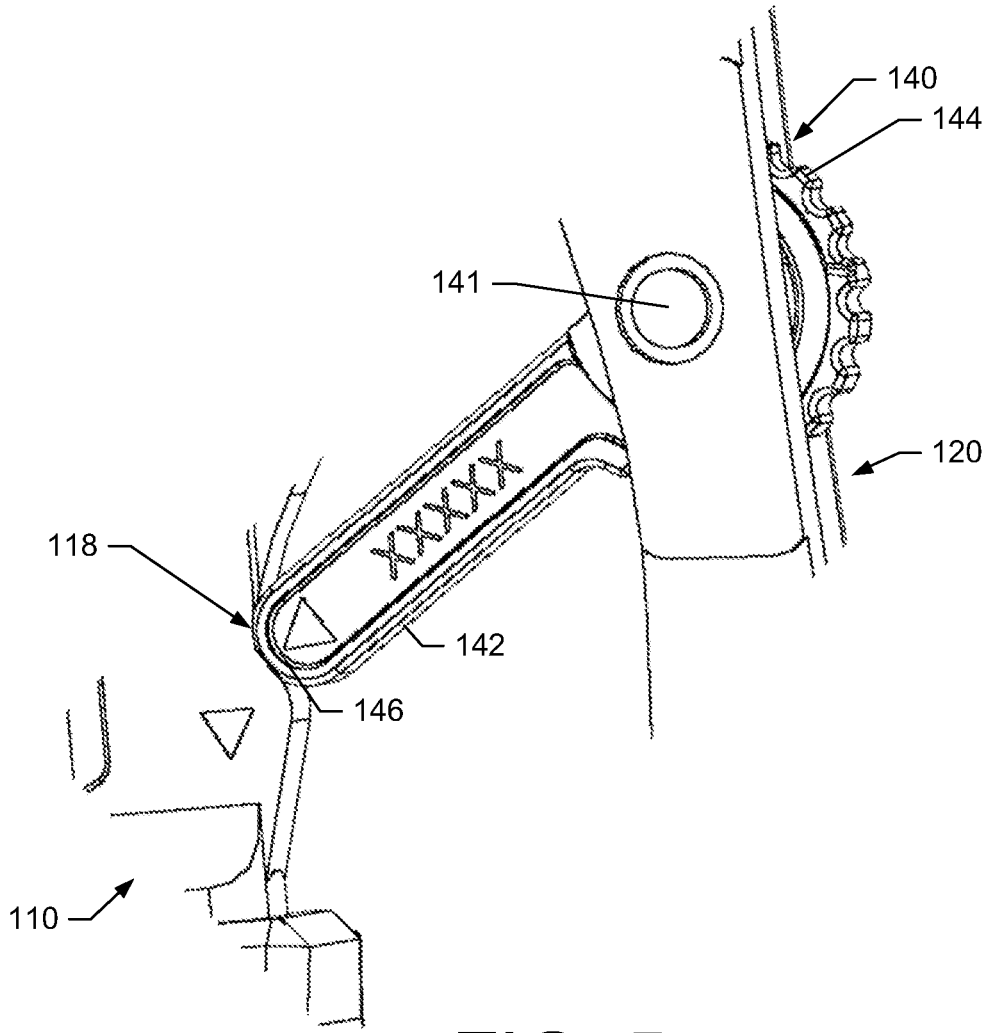
FIG. 5 illustrates a side, zoomed view of the mode selector member of the example pliers of FIG. 4 according to some example embodiments.

With reference to FIG. 4 and, with more detail, FIG. 5, the engagement between the mode selector member 140 and the first securing member 150 can be seen. In this regard, the engagement notch 118 is shown as including a concave curved portion that receives the tip 146 of the arm 142 of the mode selector member 140. The tip 146 is shown as including a convex curved surface that, according to some example embodiments, corresponds to the concave curved portion of the engagement notch 118. Additionally, the rearward side of the engagement notch 118 may be raised to ensure that the tip 146 remains seated in the engagement notch 118 when the tip 146 pivots or rotates within the engagement notch 118 during an auto-adjustment mode operation, as described above.

Figure 6:
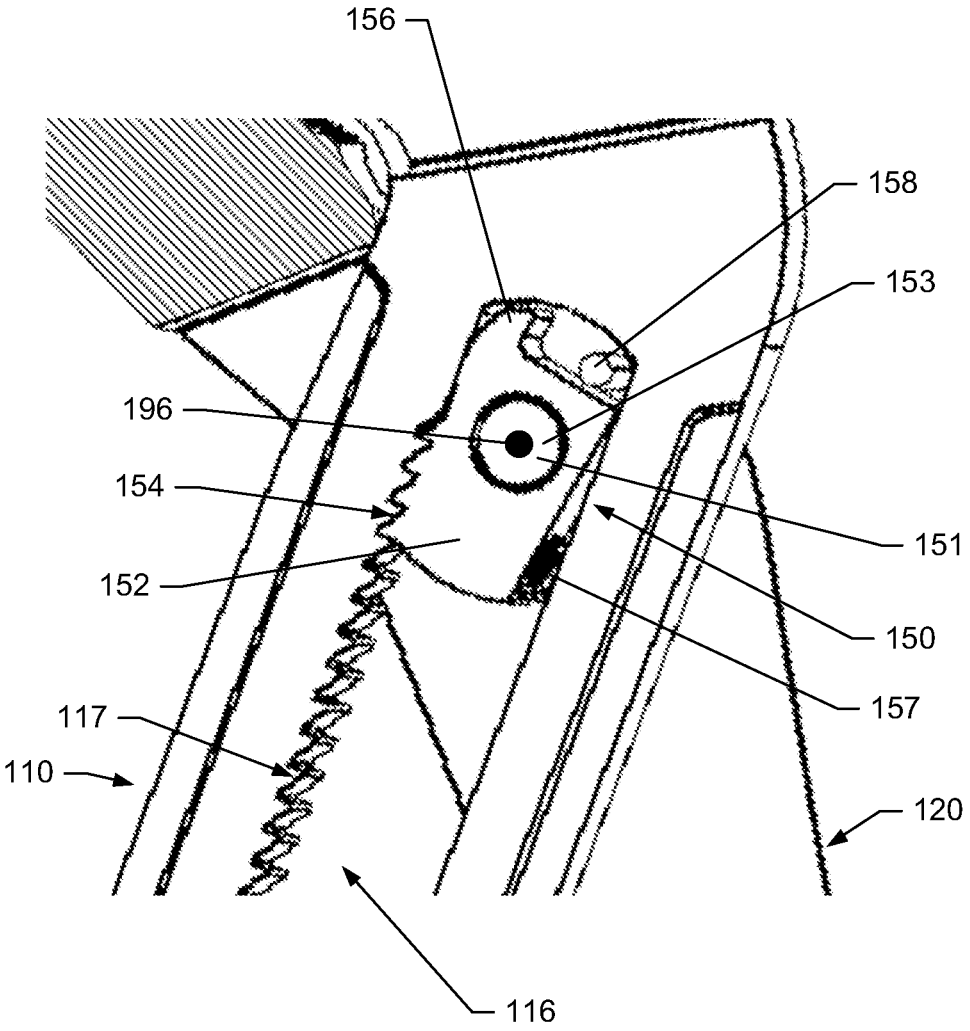
FIG. 6 illustrates a side, zoomed view of a pawl and channel of the example pliers of FIG. 4 according to some example embodiments.

Further, the cross-section view of FIG. 4, also reveals additional features of the adjustable pivot 150. In this regard, with reference to FIG. 4, as well as the zoomed view provided in FIG. 6, the adjustable pivot 150 may comprise a pawl 152. In this regard, the pawl 152 may comprise pawl teeth 154 and a pawl lever 156. The pawl teeth 154 may be configured to interface or engage with the channel teeth 117 to facilitate the adjustability features of the pliers 100. The pliers 100 may also comprise a spring 157 that urges the pawl teeth 154 into engagement with the channel teeth 117. In this regard, as best shown in FIG. 6, the pawl 152 may be narrower than the width of the channel 116, which may permit the pawl 152 to pivot about the pin 151 within the channel 116. In the absence of other outside forces, the spring 157 may force the pawl 152 into a position where the pawl teeth 154 are engaged with the channel teeth 117, and the pawl 152 is in a pivoted position within the channel 116 because the force being applied by the spring 157 is offset from the pin 151.

The pawl teeth 154 may be shaped to engage the troughs formed by the channel teeth 117. Further, either or both of the pawl teeth 154 and the channel teeth 117 may be shaped to permit ratcheting movement of the pawl 152 in the forward direction (jaws sliding together) and prevent movement of the pawl 152 in the rearward direction when the pawl teeth 154 are engaged with the channel teeth 117. In this regard, for example, the rearward faces of the channel teeth 117 may have a gradual slope (small positive slope) relative to a steep or even negative slope of the forward faces of the channel teeth 117. The pawl teeth 154 may be shaped in a corresponding fashion such that the rearward faces of the pawl teeth 154 have a steep or even negative slope and the forward faces of the pawl teeth 154 have a relatively gradual slope (small positive slope). The gradual or small positive slopes of the rearward faces of the channel teeth 117 and the forward faces of the pawl teeth 154 may allow the pawl teeth 154 to ride up the rearward faces of the channel teeth 117 (while the pawl 152 pivots against the urging of the spring 157 and compresses the spring 157) to permit ratcheting movement across the channel teeth 117 as the pawl 152 moves in a forward direction within the channel 116 during an auto-adjustment mode operation.

Additionally, due to the steep or negative slopes of the forward faces of the channel teeth 117 and the pawl teeth 154, the pawl 152, and thus the pivot position 196, may be maintained in a current position in the channel 116. As such, when the mode selector member 140 is moved into the disengaged position, the handles 112 and 122 may be moved together to close the jaws 114 and 124 without the auto-adjustment action occurring.

Figure 7:
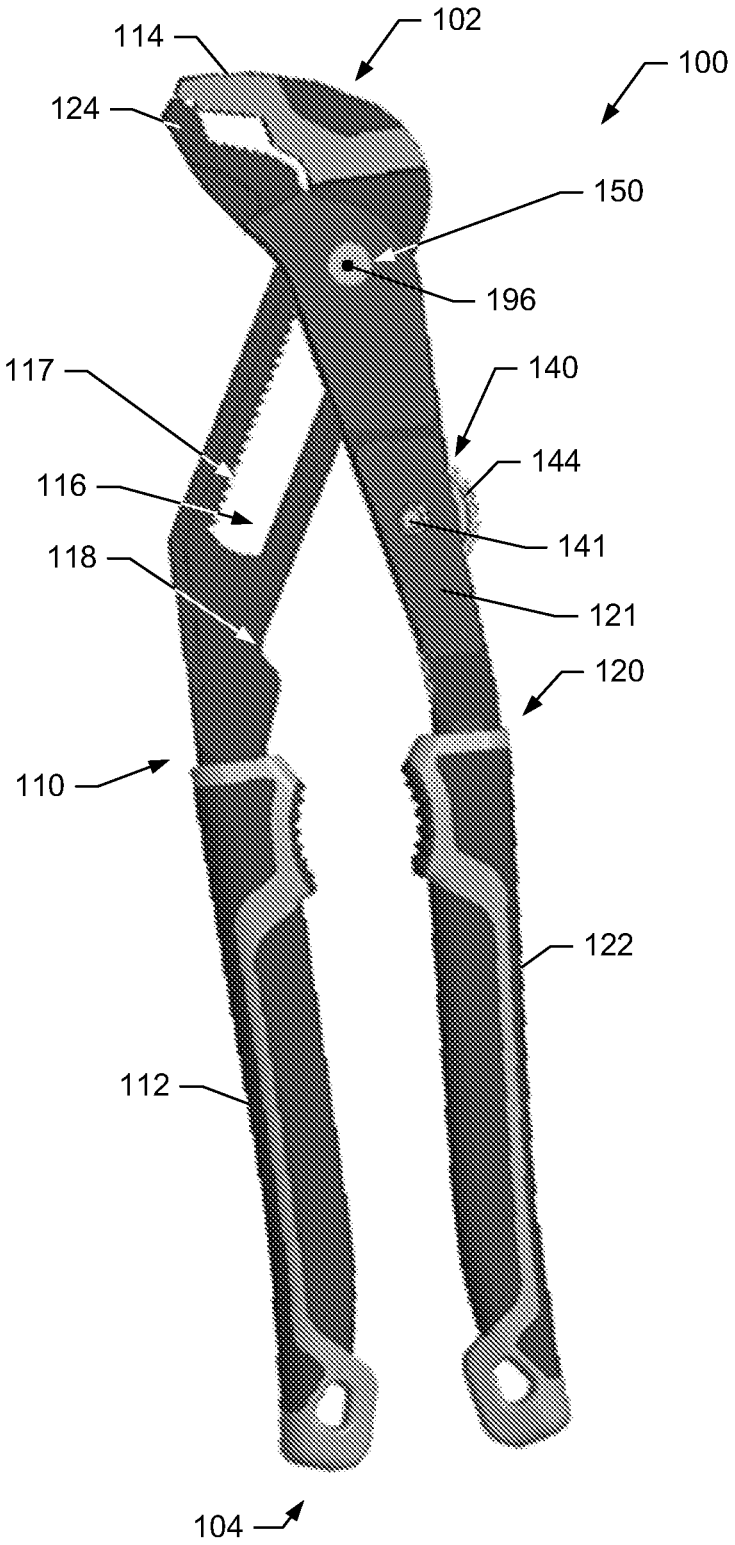
FIG. 7 illustrates a side view of example pliers in a closed position with a mode selector member in a disengaged position according to some example embodiments.
Figure 8:
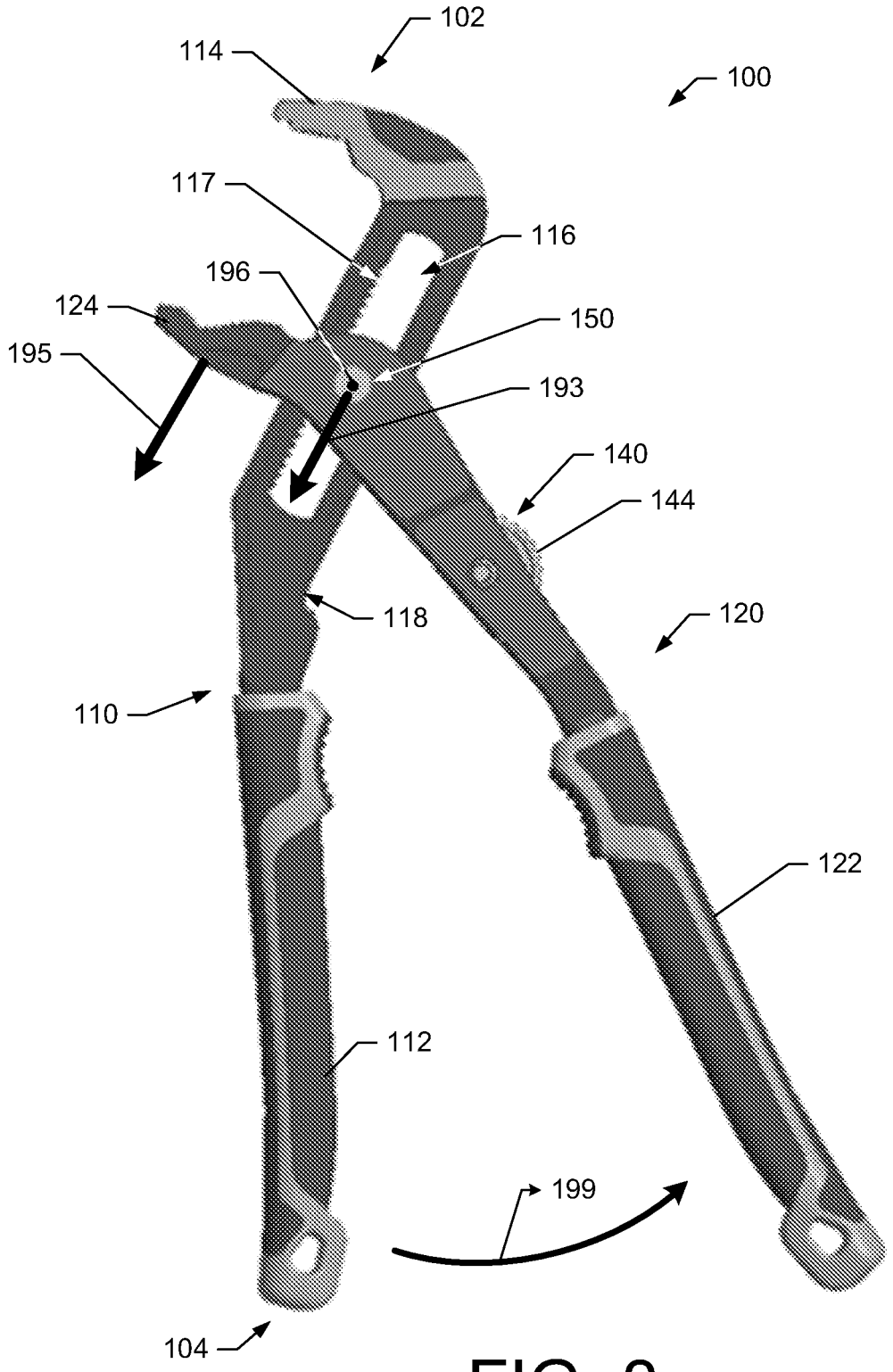
FIG. 8 illustrates a side view of example pliers in an open position with a mode selector member in a disengaged position according to some example embodiments.

In this regard, FIG. 7 illustrates a side view of the pliers 100 with the mode selector member 140 in the disengaged position and the jaws 114 and 124 closed. Additionally, as shown in FIG. 7, the arm 142 of the mode selector member 140 is hidden behind the side edge 121 within the opening 125. The user grip feature of the body portion 144 of the mode selector member 140, may, however, extend out of the opening 125 to facilitate the ability of the user to rotate the user grip feature and thereby rotate the mode selector member 140 and the arm 142 out of the disengaged position and into the engaged position against the bias of the spring 145.

The operation of adjusting the jaws 114 and 124 to increase the spacing between the jaws 114 and 124, according to some example embodiments, will now be described. In this regard, with reference to FIG. 8, the second handle 122 may be moved away from the first handle 112 in the direction 199 to pivot the second handle member 120 relative to the first handle member 110 about the pivot position 196. Referencing again FIG. 6, as the first handle member 110 rotates relative to the second handle member 120 about the pivot position 196, the pawl 152 rotates with the first handle member 110 due to the engagement with the channel teeth 117 and the spring 157. As this rotation continues, a pin 158 affixed to the second handle member 120 responsively moves toward the pawl lever 156 until the pin 158 comes into contact with the pawl lever 156. If the rotation continues after this contact is made, the pin 158 will apply a force on the pawl lever 156 to cause the pawl 152 to pivot within the channel 116 against the urging of the spring 157. As the pawl 152 pivots (in the counterclockwise direction with reference to FIG. 6), the pawl teeth 154 will be pulled out of engagement with the channel teeth 117. With the pawl teeth 154 no longer in engagement with the channel teeth 117, the adjustable pivot 150 with the pawl 152, and the pivot position 196, may be slid in the rearward direction 193 of FIG. 8 (as well as in the forward direction). The sliding motion may be a two-handed operation requiring a first hand to grasp the first handle 112 and a second hand to grasp the second handle 122 and, via the second handle 122, slide the second handle member 120, for example, in a rearward direction. Accordingly, due to the sliding movement of the second handle member 120 and the adjustable pivot 150, the second jaw 124 may also move in the direction 195. When the second handle 122 is subsequently moved toward the first handle 112, the pin 153 may disengage from the pawl lever 156 and the pawl teeth 154 may reengage with the channel teeth 117, thereby preventing further movement of the adjustable pivot 150 and the pawl 152 in the rearward direction.

Figure 9:
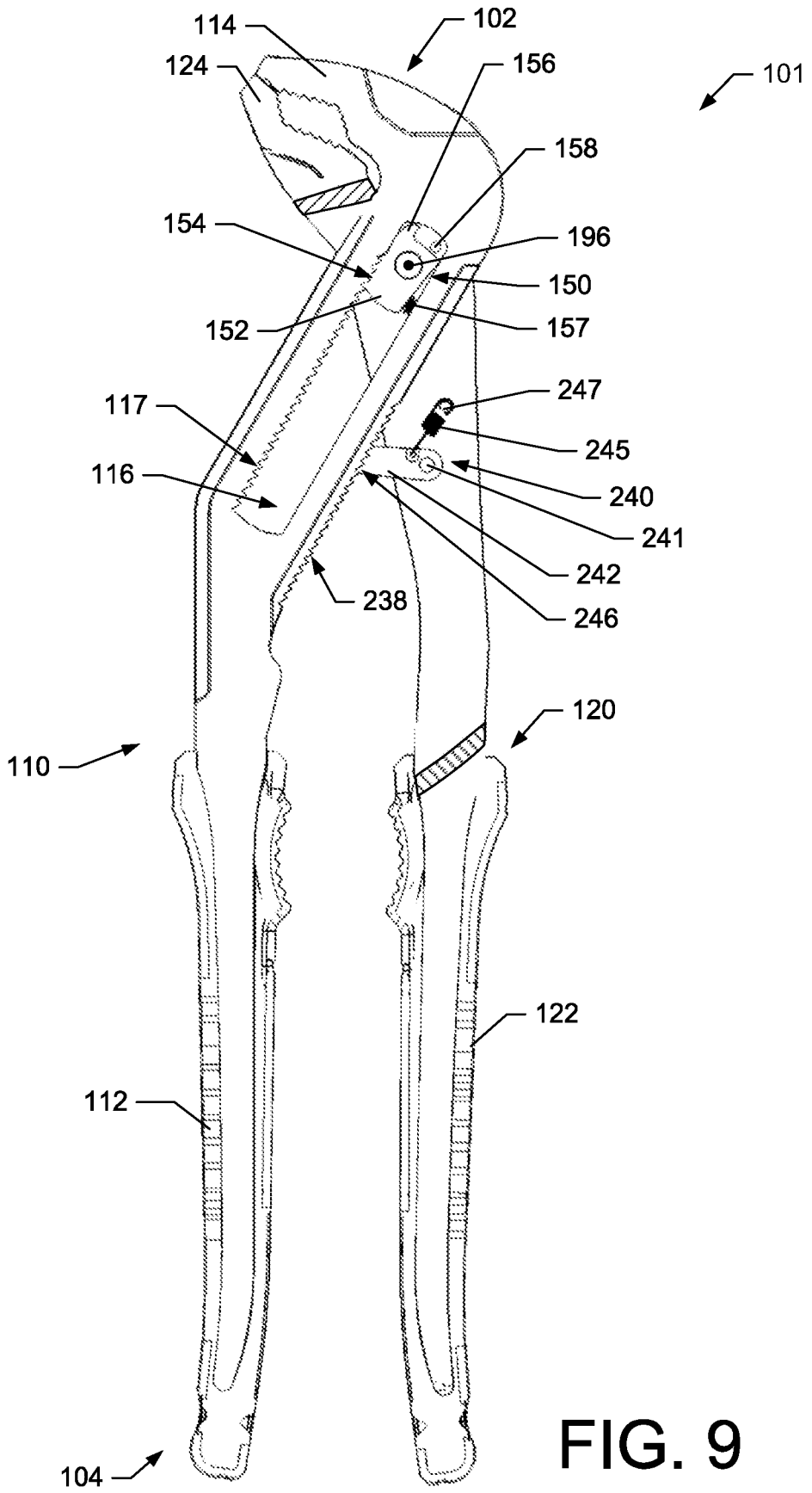
FIG. 9 illustrates a cross-section side view of example pliers with a another example mode selector member according to some example embodiments.

According to some example embodiments, FIG. 9 illustrates another example embodiment in the form of pliers 101. Pliers 101 may be similar to the pliers 100 with the exception of the mode selector member 240 and the engagement between the mode selector member 240 with the first handle member 110.

In this regard, FIG. 9 is a cross-section side view of the pliers 101 with the side member 121 removed. In this regard, the pliers 101 may comprise a mode selector member 240 that is rotatable about a pin 241 between an engaged position and a disengaged position. The mode selector member 240 may comprise an arm 242 with a toothed tip 246. The toothed tip 246 may comprise one or more teeth that are configured to interface or engage with engagement teeth 238 disposed on a top edge of the first handle member 110. The pliers 101 may also include a spring 245 that may serve a dual purpose. In this regard, similar to spring 145, the spring 245 may operate to maintain the mode selector member 240 in either the engaged position where the toothed tip 246 is engaged with the engagement teeth 238 for operation in the auto-adjustment mode or in the disengaged position where the toothed tip 246 is not engaged with the engagement teeth 238 for operation in the hand adjusting mode. However, the spring 245 may also apply a bias on the mode selector member 240 in the engaged position to facilitate ratcheting movement of the toothed tip 246 across the engagement teeth 238 to perform an auto-adjustment operation.

Because the adjustable pivot 150 is configured in the same manner in the pliers 101 as in the pliers 100, the operation of the pliers 101 in the hand adjusting mode may be similar to the description provided above. As such, operation of the pliers 101, when the mode selector member 240 is in the disengaged position may be the same as the pliers 100. However, with respect to the auto-adjustment mode, the pliers 101 may function similarly, although in a different way.

In this regard, with the mode selector member 240 in the engaged position, the toothed tip 246 may be engaged with the engagement teeth 238. As the second handle 122 is moved towards the first handle 112, the angled edge upon which the engagement teeth 238 are disposed (which is parallel to the interior channel surface upon which the channel teeth 117 are disposed), operates to cause the second handle member 120 to be moved in the forward direction, thereby also moving the adjustable pivot 150 and the pivot position 196 in the forward direction. As the second handle member 120 moves in the forward direction and slides the second jaw 124 towards the first jaw 114 in an auto-adjustment manner, the mode selector member 240 applies a force on the first handle member 110 while ratcheting in a forward direction across the engagement teeth 238. In this regard, rather than the tip of the arm rotating as provided with pliers 100, the toothed tip ratchets across the engagement teeth 238.

According to some example embodiments, dual-mode pliers are provided. In this regard, the dual-mode pliers may comprise a first handle member comprising a first handle and a first jaw, a second handle member comprising a second handle and a second jaw, and a channel disposed in the first handle member between the first handle and the first jaw. The dual-mode pliers may also comprise an adjustable pivot affixed to the second handle member and disposed within the channel of the first handle member. The second handle member may be configured to pivot relative to the first handle member about a pivot axis defined by the adjustable pivot. The dual-mode pliers may also comprise a mode selector member that is movable between an engaged position and a disengaged position. In the engaged position, the mode selector member is engaged with both the first handle member and the second handle member, and, as the second handle is moved towards the first handle, the adjustable pivot moves the pivot axis within the channel to slide the second jaw towards first jaw. In the disengaged position, the mode selector member is not engaged with both the first handle member and the second handle member, and, as the second handle is moved towards the first handle, the adjustable pivot maintains a position of the pivot axis within the channel.

According to some example embodiments, the adjustable pivot may be affixed to the second handle member between the second jaw and the second handle, and the mode selector member may be affixed to the second handle member between the adjustable pivot and the second handle. Additionally or alternatively, according to some example embodiments, the mode selector member may be configured to pivot between the engaged position and the disengaged position. Additionally or alternatively, according to some example embodiments, the mode selector member may comprise an arm with a rounded end, and the first handle member may comprise an engagement notch configured to receive the rounded end of the arm of the mode selector member as the mode selector member is in the engaged position. Additionally or alternatively, according to some example embodiments, the rounded end of the arm of the mode selector member may rotate within the engagement notch of the first handle member when the adjustable pivot moves within the channel. Additionally or alternatively, according to some example embodiments, the adjustable pivot may comprise a pawl, and the pawl may comprise pawl teeth. The channel may also comprise channel teeth and the pawl may be spring-biased to urge the pawl teeth towards engagement with the channel teeth. Additionally or alternatively, according to some example embodiments, the pawl may further comprise a pawl lever that extends from the pawl. The second handle member may further comprise a pin, and, as the first handle is moved away from the second handle, the pawl lever may move toward the pin until the pawl level engages with the pin such that continued movement of the first handle away from the second handle causes the pawl teeth to disengage from the channel teeth. Additionally or alternatively, according to some example embodiments, in the engaged position, as the first handle is moved towards the second handle, the pawl teeth ratchet across the channel teeth as the pivot axis moves within channel slide the second jaw towards first jaw. Additionally or alternatively, according to some example embodiments, the mode selector member may comprise an arm with selector teeth disposed at an end of the arm, and the first handle member may comprise engagement teeth disposed on an external edge of the first handle member. Further, the dual-mode pliers may further comprise a spring coupled to the mode selector member and the second handle member. The spring may be configured to urge the selector teeth towards engagement with the engagement teeth. Additionally or alternatively, according to some example embodiments, in the engaged position, the selector teeth may be engaged with the engagement teeth, and, as the second handle is moved towards the first handle, the selector teeth ratchet across the engagement teeth.

According to some example embodiments, adjustable pliers configured to transition between an auto-adjustment mode and a hand adjustment mode are provided. The adjustable pliers may comprise a first handle member comprising a first handle and a first jaw, a second handle member comprising a second handle and a second jaw, a channel disposed in the first handle member between the first handle and the first jaw, and an adjustable pivot affixed to the second handle member and disposed within the channel. The second handle member may be configured to pivot relative to the first handle member about a pivot axis defined by the adjustable pivot. The adjustable pliers may also comprise a mode selector member that is affixed to the second handle member between the adjustable pivot and the second handle. The mode selector member may be rotatable between an engaged position, where the mode selector member is in contact with the first handle member, and a disengaged position, where the mode selector member is not in contact with the first handle member. In the engaged position, as the first handle is moved towards the second handle, the adjustable pivot moves the pivot axis within the channel to slide the second jaw towards first jaw. In the disengaged position, as the first handle is moved towards the second handle, the adjustable pivot maintains a position of the pivot axis within the channel.

Additionally, according to some example embodiments, the adjustable pliers may further comprise a mode selector spring coupled to the mode selector member. The mode selector spring may be configured to bias the rotational movement of the selector member to maintain the mode selector member in a current position. In this regard, the current position may be the engaged position or the disengaged position. Additionally or alternatively, according to some example embodiments, the mode selector member may comprise an arm with a rounded end, and the first handle member may comprise an engagement notch configured to receive the rounded end of the arm of the mode selector member when the mode selector member is in the engaged position. Additionally or alternatively, according to some example embodiments, the rounded end of the arm of the mode selector member may rotate within the engagement notch of the first handle member as the adjustable pivot moves within the channel. Additionally or alternatively, according to some example embodiments, the adjustable pivot is affixed to the second handle member between the second jaw and the adjustable pivot. Additionally or alternatively, according to some example embodiments, the adjustable pivot may comprise a pawl, and the pawl may comprise pawl teeth. The channel may comprise channel teeth, and the pawl may be spring-biased to urge the pawl teeth towards engagement with the channel teeth. Additionally or alternatively, according to some example embodiments, the pawl may further comprise a pawl lever that extends from the pawl. The second handle member may further comprise a pin, and, as the first handle is moved away from the second handle, the pawl lever may move toward the pin until the pawl level engages with the pin such that continued movement of the first handle away from the second handle causes the pawl teeth to disengage from the channel teeth. Additionally or alternatively, according to some example embodiments, in the engaged position, as the first handle is moved towards the second handle, the pawl teeth may ratchet across the channel teeth as the pivot axis moves within channel slide the second jaw towards first jaw. Additionally or alternatively, according to some example embodiments, the mode selector member may comprise an arm with selector teeth disposed at an end of the arm, and the first handle member may comprise engagement teeth disposed on an external edge of the first handle member. The adjustable pliers may further comprise a spring coupled to the mode selector member and the second handle member. The spring may be configured to urge the selector teeth towards engagement with the engagement teeth. Additionally or alternatively, according to some example embodiments, in the engaged position, the selector teeth may be engaged with the engagement teeth, and, as the second handle is moved towards the first handle, the selector teeth may ratchet across the engagement teeth.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. Dual-mode pliers comprising:

a first handle member comprising a first handle and a first jaw;

a second handle member comprising a second handle and a second jaw;

a channel disposed in the first handle member between the first handle and the first jaw;

an adjustable pivot affixed to the second handle member and disposed within the channel of the first handle member, the second handle member being configured to pivot relative to the first handle member about a pivot axis defined by the adjustable pivot; and a mode selector member that is movable between an engaged position and a disengaged position;

wherein in the engaged position the mode selector member is engaged with both the first handle member and the second handle member, and, as the second handle is moved towards the first handle, the adjustable pivot moves the pivot axis within the channel to slide the second jaw towards first jaw;

wherein in the disengaged position the mode selector member is not engaged with both the first handle member and the second handle member, and, as the second handle is moved towards the first handle, the adjustable pivot is not compelled to move a position of the pivot axis within the channel.

2. The dual-mode pliers of claim 1, wherein the adjustable pivot is affixed to the second handle member between the second jaw and the second handle; and wherein the mode selector member is affixed to the second handle member between the adjustable pivot and the second handle.

3. The dual-mode pliers of claim 1, wherein the mode selector member is configured to pivot between the engaged position and the disengaged position.

4. The dual-mode pliers of claim 1, wherein the mode selector member comprises an arm with a rounded end;

wherein the first handle member comprises an engagement notch configured to receive the rounded end of the arm of the mode selector member as the mode selector member is in the engaged position.

5. The dual-mode pliers of claim 4, wherein the rounded end of the arm of the mode selector member rotates within the engagement notch of the first handle member when the adjustable pivot moves within the channel.

6. The dual-mode pliers of claim 1, wherein the adjustable pivot comprises a pawl, the pawl comprising pawl teeth;

wherein the channel comprises channel teeth; and wherein the pawl is spring-biased to urge the pawl teeth towards engagement with the channel teeth.

7. The dual-mode pliers of claim 6, wherein the pawl further comprises a pawl lever that extends from the pawl;

wherein the second handle member further comprises a pin;

wherein, as the first handle is moved away from the second handle, the pawl lever moves toward the pin until the pawl level engages with the pin such that continued movement of the first handle away from the second handle causes the pawl teeth to disengage from the channel teeth.

8. The dual-mode pliers of claim 6, wherein, in the engaged position, as the first handle is moved towards the second handle, the pawl teeth ratchet across the channel teeth as the pivot axis moves within channel slide the second jaw towards first jaw.

9. The dual-mode pliers of claim 1, wherein the mode selector member comprises an arm with selector teeth disposed at an end of the arm;

wherein the first handle member comprises engagement teeth disposed on an external edge of the first handle member;

wherein the dual-mode pliers further comprise a spring coupled to the mode selector member and the second handle member, the spring being configured to urge the selector teeth towards engagement with the engagement teeth.

10. The dual-mode pliers of claim 9, wherein, in the engaged position, the selector teeth are engaged with the engagement teeth, and, as the second handle is moved towards the first handle, the selector teeth ratchet across the engagement teeth.

11. Adjustable pliers configured to transition between an auto-adjustment mode and a hand adjustment mode, the adjustable pliers comprising:

a first handle member comprising a first handle and a first jaw;

a second handle member comprising a second handle and a second jaw;

a channel disposed in the first handle member between the first handle and the first jaw;

an adjustable pivot affixed to the second handle member and disposed within the channel, the second handle member being configured to pivot relative to the first handle member about a pivot axis defined by the adjustable pivot; and a mode selector member that is affixed to the second handle member between the adjustable pivot and the second handle, the mode selector member being rotatable between an engaged position where the mode selector member is in contact with the first handle member and a disengaged position where the mode selector member is not in contact with the first handle member;

wherein, in the engaged position, as the first handle is moved towards the second handle, the adjustable pivot moves the pivot axis within the channel to slide the second jaw towards first jaw;

wherein, in the disengaged position, as the first handle is moved towards the second handle, the adjustable pivot is not compelled to move a position of the pivot axis within the channel.

12. The adjustable pliers of claim 11, further comprising a mode selector spring coupled to the mode selector member, the mode selector spring being configured to bias the rotational movement of the selector member to maintain the mode selector member in a current position, the current position being the engaged position or the disengaged position.

13. The adjustable pliers of claim 11, wherein the mode selector member comprises an arm with a rounded end;

wherein the first handle member comprises an engagement notch configured to receive the rounded end of the arm of the mode selector member when the mode selector member is in the engaged position.

14. The adjustable pliers of claim 13, wherein the rounded end of the arm of the mode selector member rotates within the engagement notch of the first handle member as the adjustable pivot moves within the channel.

15. The adjustable pliers of claim 11, wherein the adjustable pivot is affixed to the second handle member between the second jaw and the adjustable pivot.

16. The adjustable pliers of claim 11, wherein the adjustable pivot comprises a pawl, the pawl comprising pawl teeth;

wherein the channel comprises channel teeth; and wherein the pawl is spring-biased to urge the pawl teeth towards engagement with the channel teeth.

17. The adjustable pliers of claim 16, wherein the pawl further comprises a pawl lever that extends from the pawl;

wherein the second handle member further comprises a pin;

wherein, as the first handle is moved away from the second handle, the pawl lever moves toward the pin until the pawl level engages with the pin such that continued movement of the first handle away from the second handle causes the pawl teeth to disengage from the channel teeth.

18. The adjustable pliers of claim 16, wherein, in the engaged position, as the first handle is moved towards the second handle, the pawl teeth ratchet across the channel teeth as the pivot axis moves within channel slide the second jaw towards first jaw.

19. The adjustable pliers of claim 11, wherein the mode selector member comprises an arm with selector teeth disposed at an end of the arm;

wherein the first handle member comprises engagement teeth disposed on an external edge of the first handle member;

wherein the adjustable pliers further comprise a spring coupled to the mode selector member and the second handle member, the spring being configured to urge the selector teeth towards engagement with the engagement teeth.

20. The adjustable pliers of claim 11, wherein, in the engaged position, the selector teeth are engaged with the engagement teeth, and, as the second handle is moved towards the first handle, the selector teeth ratchet across the engagement teeth.

* * * * *